US006135376A

United States Patent [19]

Vedefors

[11] Patent Number: 6,135,376

[45] Date of Patent: Oct. 24, 2000

[54] DEVICE FOR DISINTEGRATING

[76] Inventor: Kent Vedefors, Brahegatan 22, S-563 32 Gränna, Sweden

[21] Appl. No.: 09/171,275

[22] PCT Filed: Apr. 15, 1997

[86] PCT No.: PCT/SE97/00628

§ 371 Date: Oct. 13, 1998

§ 102(e) Date: Oct. 13, 1998

[87] PCT Pub. No.: WO97/38793

PCT Pub. Date: Oct. 23, 1997

[30] Foreign Application Priority Data

Apr. 15, 1996 [SE] Sweden ..... 9601434

[51] Int. Cl.[7] ..... B02C 18/12

[52] U.S. Cl. ..... 241/278.1; 241/282.1

[58] Field of Search ..... 241/278.1, 282.1, 241/282.2

[56] References Cited

U.S. PATENT DOCUMENTS 2,620,138 12/1952 Vazieux et al. ..... 241/278.1

3,224,687 12/1965 Bidwell ..... 241/278.1

*Primary Examiner*—Mark Rosenbaum

*Attorney, Agent, or Firm*—Fasth Law Offices; Rolf Fasth

[57] ABSTRACT

A device for disintegrating material such as fruit, vegetables, corn and meat products. The device has a disintegrator that is displaceably driven in relation to a dolly. A rotatably driven reception disc supports a plurality of displaceably driven and disintegrating knives that are eccentrically journalled so that an axis of rotation (7) is radially displaced from an axis of rotation (6) of the reception disc. The dolly is arranged along the circumference of the reception disc and along the path of a motion of the disintegrating knives.

8 Claims, 2 Drawing Sheets

DEVICE FOR DISINTEGRATING

The present invention relates to a device for disintegrating material, especially from the vegetable or the animal kingdom like e.g. fruit, vegetable, meat products and corn, by means of a disintegrator which is displaceable driven in relation to a dolly.

Prior art disintegrators for material that are designed for slicing e.g. fruit, vegetables and meat products, for disintegrating e.g. compostable material, for grinding down e.g. corn and seed, for mashing e.g. cowberry or other berries in order to produce e.g. raw mashed cowberry or for cutting/chopping e.g. straw, grass or other plant material have so far disclosed small effective work surface, have been noisy, have been power consuming, have been operating at high speeds, have been difficult and complicated to handle and to clean, have been generating a lot of heat and have been made up of a lot of components.

The main object of the present invention is therefore in the first place to solve among other said problem by means of efficiently functioning means.

Said object is achieved by means of a device according to the present invention, which is mainly characterized in that a rotatable driven reception disc for material supports a plurality of displaceable driven disintegrating knives which are excentrically journalled, i.e. that its axis of rotation is radially displaced from the axis of rotation of the reception disc and that the dolly is arranged along the circumference of the reception disc and along the path of motion of said disintegrating knives.

Figure 1:
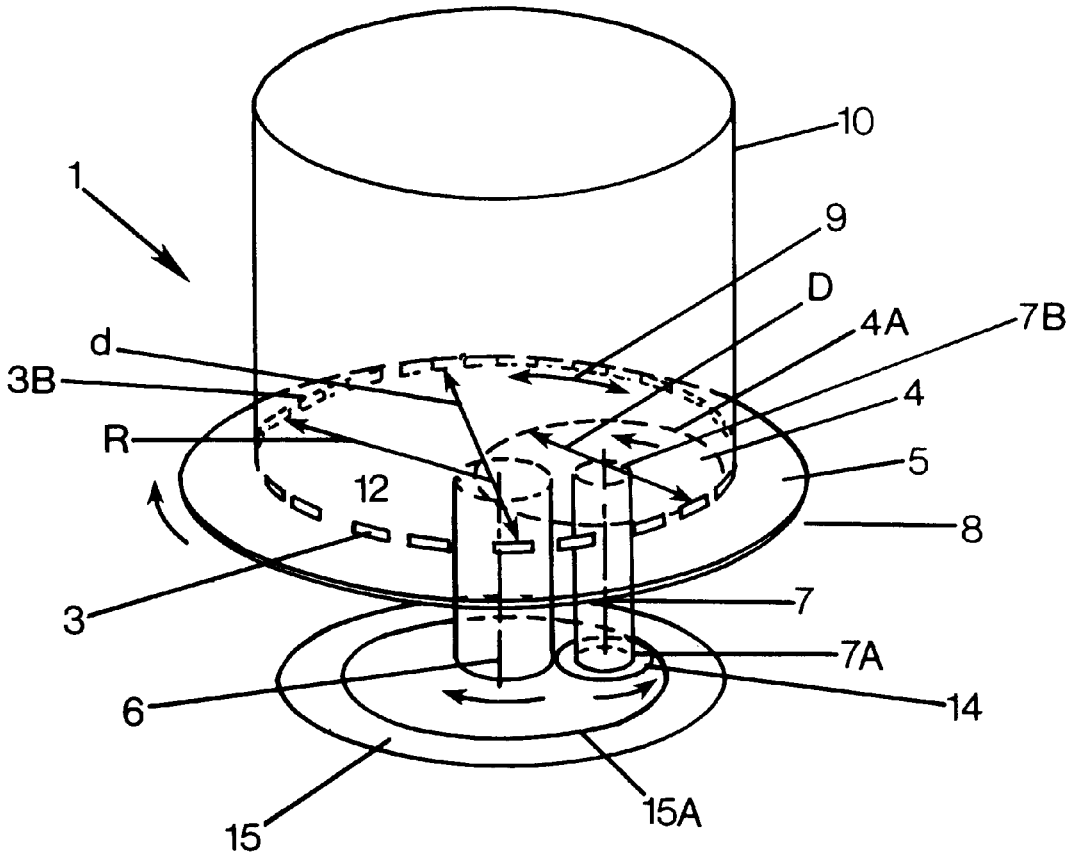
Figure 2:
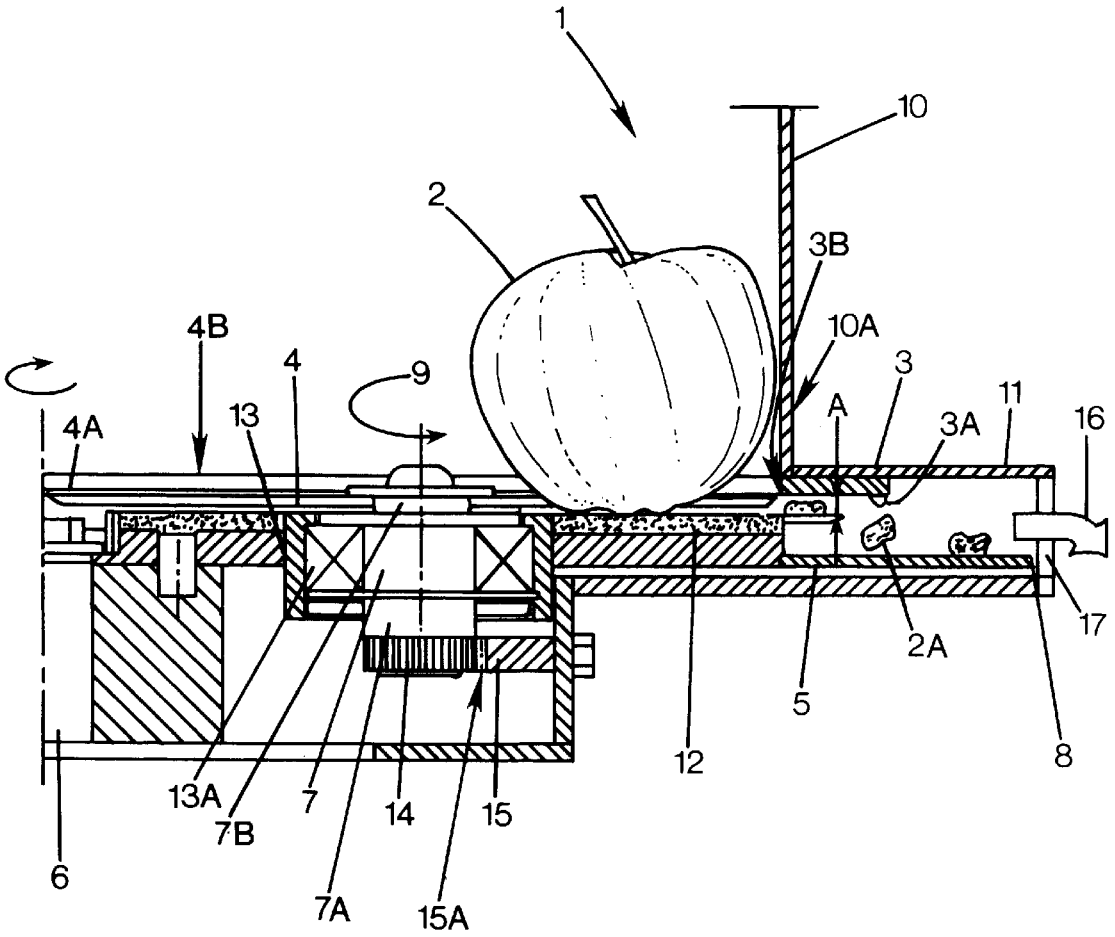

The invention is described here below as a preferred embodiment, wherein is referred to the accompanying drawings in which:

FIG. 1 shows in a perspective a disintegrating device partly in section, and FIG. 2 shows in a cross section view a part of the disintegrating device.

A device 1 which is designed in accordance with the present invention which is intended for disintegrating material 2, especially from the vegetable or the animal kingdom like e.g. fruit, vegetables, meat products and corn, by means of a disintegrator 4 which is displaceable driven in relation to a dolly 3, has a rotatable driven reception disc 5 for material 2. Said reception disc 5 supports a plurality of displaceable driven disintegrating knives 4 which are excentrically journalled relative to a drive shaft 6, i.e. the axis 7 of rotation of said disintegrating knives is radially displaced from the axis 6 of rotation of the reception disc 5. The dolly 3 is by that arranged to extend preferably unbroken along the circumference 8 of the reception disc and along the path of motion 9 of said disintegrating knives. The rotation of the reception disc 5 is accomplished by means of a not shown motor, which transmits the drive force via the shaft 6 to said disc 5, which is attached to the shaft 6 by means of draw key. The distance A between the dolly 3 and the reception disc 5 is variable by moving them relative to each other. The dolly 3 is located at the bottom end 10A of an input member 10, which may be cylinder shaped or have any other suitable shape, e.g. conical, and which is arranged for internal reception of material 2 which should be disintegrated by means of the knife/knives 4. The dolly 3 is also located at an inner end 11A of a machine chassis 11.

A disintegrating knife 4 having a circular outer periphery is provided with a diameter D which exceeds the radius R for the active internal member 12 of the reception disc 5 which is limited by said dolly 3.

According to a not shown preferred embodiment, a plurality of disintegrating knives, having circular outer periphery, are evenly distributed along the rotational axis 6 of the reception disc. The respective diameter of the knives is thereby equal to or less than the radius of the active part of the reception disc which is limited by said dolly.

The respective disintegrating knife 4 is preferably driven by means of a drive apparatus with a speed which enables the circumference 4A of the knife 4 to cover a distance which is at least as big as the length of the inner diameter d of the circular dolly 3.

The disintegrating knife/knives 4 are freely supported by a drive shaft 7 extending through an opening 13 defined in the reception disc. A bearing 13A is disposed between the drive shaft 7 and the reception disc in the opening 13. A traversing wheel 14, gearwheel, roller, etc is supported at one side 7A of the drive shaft 7 sleeve so that the wheel 14 can cooperate with an encompassing ball race 15.

A plurality of disintegrating knives may be arranged in a stack, preferably with mutual distances. Further, said disintegrating knives may be provided with a peripheral edge 4A which may have a straight angle or some other angle, may be arranged to be supported so that their upper surface 4B is located beneath the bottom surface 3A of the dolly 3.

Said reception disc 5 extends past said dolly 3 as seen in the radial direction, wherein the processed material 2A is influenced by the disc 5 to be thrown out radially 16 through a slit shaped outlet opening 17.

When the central drive shaft 6 is influenced by the motor to rotate, the beneath it located traversing wheels 14 are influenced to rotate by the friction against the traversing wheel 15 and its internal surface 15A, which transmits the rotation to the knife drive shaft 7 and further to the circular knife 4 which is attached to the upper end 7B of the shaft.

By altering the diameter of the traversing wheel 14, traversing wheel 15, knife 4 and dolly 3, and the distance between the knife drive shaft 7 and the central drive shaft 6 may different kinds of properties easily be changed, like the peripheral speed of knife, and also the press force between said knife and dolly.

Thus, by varying the column width A between the reception disc 5 and the dolly 3, different knife disc widths, degree of crushing/disintegrating and also the length of vegetable material, e.g. straw, may be regulated.

If a plurality of circular knifes are used, these may be mounted on top of each other, with or without situated in between distances, to operate against the respective dolly.

If the circular knife 4 rotates around its shaft 7 with such a speed that its periphery covers a distance which is at least as large as the length of the inner mantle surface 3B of the dolly 3 which it operates against which causes the material 2 to be clamped between the dolly 3 and the knife 4 which then at the same time presses and cuts through the material 2. When the material 2 shall be crushed/pressed, it is the optimum that these distances are equal in length and therefore the knife 4 does not cut but it only presses the material 2 in through the slit opening between the dolly 3 and the reception disc 5, and that a knife with a straight edge is used.

Instead of using only one input member 10 in the in the form of for example a large cylinder shaped funnel, a number of smaller input funnels may be arranged partly as inset to the large funnel, partly as separate funnels with their own dollies, e.g. for slicing cucumber with a good repetition accuracy of cutting angle. For this object, it is important that the inner diameter (and thereby the input material to be processed) is not larger than the radius measure of the circle knife (active working surface).

The inventive concept is disclosed by the above and by the example shown in the drawings, but the invention is not limited to that embodiment and may be varied within the scope of the claims without departing from the scope of the invention.

What is claimed is:

1. A disintegration device for disintegrating a material, comprising:

a dolly;

a rotatably driven reception disc being rotatable about a first axis of the dolly, the reception disc having a circumference and a radius;

a first disintegrating knife and a second disintegrating knife being rotatable about a second axis, the first disintegrating knife being stacked above the second disintegrating knife, the disintegrating knives being eccentrically journalled so that the second axis is radially displaced from the first axis, the disintegrating knives being supported by the reception disc and movable along a path of motion, the disintegrating knives having an operational peripheral diameter being greater than the radius of the reception disc; and the dolly being disposed along the circumference of the reception disc and in the path of motion of the disintegrating knives.

2. A disintegration device according to claim 1 wherein a variable distance is defined between the dolly and the reception disc.

3. A disintegration device according to claim 1 wherein the dolly is located at a lower end of an input member and an inner end of a machine frame.

4. A disintegration device according to claim 1 wherein the disintegrating knives have circular outer peripheries that are distributed along a rotational axis of the reception disc.

5. A disintegration device according to claim 1 wherein the disintegrating knives are driven by a driving apparatus that has a rotational speed and the disintegrating knives have a circumference that is adjacent an inner diameter (d) of the dolly.

6. A disintegration device according to claim 1 wherein the disintegrating knives are supported by a drive shaft that extends through the reception disc and the drive shaft has a traversing wheel that is in operative engagement with a ball race.

7. A disintegration device according to claim 1 wherein the disintegrating knives each has an upper surface that is disposed below a bottom surface of the dolly.

8. A disintegration device according to claim 1 wherein the reception disc extends radially beyond the dolly.

* * * * *